US007886666B2

(12) United States Patent
Williams et al.

(10) Patent No.: US 7,886,666 B2
(45) Date of Patent: Feb. 15, 2011

(54) METHOD AND APPARATUS FOR A PROJECTILE INCORPORATING A METASTABLE INTERSTITIAL COMPOSITE MATERIAL

(75) Inventors: Keith Williams, Edgefield, SC (US); Michael Joseph Maston, Oak Ridge, TN (US)

(73) Assignee: Newtec Services Group, Inc., Edgefield, SC (US)

( * ) Notice: Subject to any disclaimer, the term of this patent is extended or adjusted under 35 U.S.C. 154(b) by 0 days.

(21) Appl. No.: 12/711,835

(22) Filed: Feb. 24, 2010

(65) Prior Publication Data

US 2010/0288151 A1 Nov. 18, 2010

Related U.S. Application Data

(62) Division of application No. 11/145,352, filed on Jun. 3, 2005, now Pat. No. 7,770,521.

(51) Int. Cl.
*F42B 12/44* (2006.01)

(52) U.S. Cl. ..... 102/302

(58) Field of Classification Search ..... 102/302, 102/514–528

See application file for complete search history.

(56) References Cited

U.S. PATENT DOCUMENTS

| | | | |
|---|---|---|---|
| 2,315,853 | A | 4/1943 | Hodgson |
| 3,144,827 | A | 8/1964 | Boutwell |
| 3,232,233 | A | 2/1966 | Singleton |
| 3,356,029 | A | 12/1967 | Seidel |
| 3,659,528 | A | 5/1972 | Santala |
| 3,749,021 | A | 7/1973 | Burgess |
| 3,875,864 | A | 4/1975 | Ambrosini et al. |
| 3,888,636 | A | 6/1975 | Sczerzenie et al. |
| 4,131,498 | A | 12/1978 | Lucy |
| 4,216,722 | A | 8/1980 | Angell |
| 4,328,750 | A | 5/1982 | Oberg et al. |
| 4,417,521 | A | 11/1983 | Dahlitz |
| 4,465,883 | A | 8/1984 | Lopata et al. |
| 4,495,870 | A | 1/1985 | Bell |
| 4,779,535 | A | 10/1988 | Maki |
| 4,836,108 | A | 6/1989 | Kegel et al. |
| 4,858,534 | A | 8/1989 | Wallace |
| 4,970,960 | A | 11/1990 | Feldmann |
| 5,148,750 | A | 9/1992 | Becker et al. |
| 5,198,616 | A | 3/1993 | Anderson |
| 5,237,930 | A | 8/1993 | Belanger et al. |

(Continued)

OTHER PUBLICATIONS

U.S. Appl. No. 12/132,246, entitled Method and Apparatus for Self-Destruct Frangible Projectiles.

(Continued)

*Primary Examiner*—Troy Chambers
(74) *Attorney, Agent, or Firm*—Dority & Manning, PA

(57) ABSTRACT

A method and apparatus for incorporating nanophase elemental materials and metastable interstitial composite materials into projectiles, projectile fragments, ordnance casings, warheads and structural components. The projectile, fragments and casings include an elemental material capable of oxidizing. A coating material that is capable of preventing oxidation of the elemental material and an oxidizing agent may be present and be capable of reacting with the elemental material so that a self-propagating high temperature synthesis reaction from a stabilized solid material is yielded for the purpose of rendering terminal effects or thermal impact to a target at impact.

20 Claims, 8 Drawing Sheets

U.S. PATENT DOCUMENTS

| | | | |
|---|---|---|---|
| 5,261,941 | A | 11/1993 | Sheinberg |
| 5,264,022 | A | 11/1993 | Haygarth et al. |
| 5,299,501 | A | 4/1994 | Anderson |
| 5,527,376 | A | 6/1996 | Amick et al. |
| 5,656,792 | A | 8/1997 | Rentzsch et al. |
| 5,717,159 | A | 2/1998 | Dixon et al. |
| 5,719,352 | A | 2/1998 | Griffen |
| 5,760,317 | A | 6/1998 | Kapoor |
| 5,760,331 | A | 6/1998 | Lowden |
| 5,763,819 | A | 6/1998 | Huffman |
| 5,767,438 | A | 6/1998 | Lang et al. |
| 5,831,188 | A | 11/1998 | Amick et al. |
| 5,852,255 | A | 12/1998 | Hallis et al. |
| 5,852,858 | A | 12/1998 | Hallis et al. |
| 5,880,398 | A | 3/1999 | Crilly et al. |
| 5,907,121 | A | 5/1999 | Fritze |
| 5,913,256 | A | 6/1999 | Lowden et al. |
| 5,963,776 | A | 10/1999 | Lowden et al. |
| 6,016,754 | A | 1/2000 | Enlow et al. |
| 6,024,021 | A | 2/2000 | Schultz |
| 6,071,359 | A | 6/2000 | Wisniewski et al. |
| 6,090,178 | A | 7/2000 | Benini |
| 6,101,949 | A | 8/2000 | Maucourt et al. |
| 6,115,894 | A | 9/2000 | Huffman |
| 6,135,028 | A | 10/2000 | Kuhns et al. |
| 6,149,705 | A | 11/2000 | Lowden et al. |
| 6,174,494 | B1 | 1/2001 | Lowden et al. |
| 6,248,150 | B1 | 6/2001 | Amick |
| 6,263,798 | B1 | 7/2001 | Benini |
| 6,308,607 | B1 | 10/2001 | Woodall et al. |
| 6,317,946 | B1 | 11/2001 | Beal |
| 6,439,124 | B1 | 8/2002 | Enlow et al. |
| 6,536,352 | B1 | 3/2003 | Nadkarni et al. |
| 6,546,838 | B2 | 4/2003 | Zavitsanos et al. |
| 6,546,875 | B2 | 4/2003 | Vaughn et al. |
| 6,629,485 | B2 | 10/2003 | Vaughn et al. |
| 6,679,176 | B1 | 1/2004 | Zavitsanos et al. |
| 6,691,622 | B2 | 2/2004 | Zavitsanos et al. |
| 6,722,283 | B1 | 4/2004 | Dindl et al. |
| 6,749,802 | B2 | 6/2004 | Amick |
| 6,799,518 | B1 | 10/2004 | Williams |
| 6,823,798 | B2 | 11/2004 | Amick |
| 6,884,276 | B2 | 4/2005 | Amick |
| 6,916,354 | B2 | 7/2005 | Elliott |
| 6,935,217 | B2 | 8/2005 | Beal |
| 6,960,319 | B1 | 11/2005 | Kapoor |
| 7,000,524 | B2 | 2/2006 | Beal |
| 7,059,233 | B2 | 6/2006 | Amick |
| 7,329,382 | B2 | 2/2008 | Amick |
| 7,380,503 | B2 | 6/2008 | Williams et al. |
| 2002/0005137 | A1 | 1/2002 | Stone |
| 2002/0152914 | A1 | 10/2002 | Cox |
| 2002/0174794 | A1 | 11/2002 | Lowden et al. |
| 2003/0101891 | A1 | 6/2003 | Amick |
| 2003/0167956 | A1 | 9/2003 | Kellner |
| 2003/0209164 | A1 | 11/2003 | Pi |
| 2004/0112243 | A1 | 6/2004 | Amick |
| 2004/0159262 | A1 | 8/2004 | LeaSure |
| 2005/0066850 | A1 | 3/2005 | Leblanc et al. |
| 2005/0087088 | A1 | 4/2005 | Lacy et al. |
| 2005/0188886 | A1 | 9/2005 | Vasal et al. |
| 2005/0188889 | A1 | 9/2005 | Machina et al. |
| 2005/0188890 | A1 | 9/2005 | Tarrant |
| 2006/0144281 | A1 | 7/2006 | William et al. |

OTHER PUBLICATIONS

Nanoscale Chemistry Yields Better Explosives, Lawrence Livermore Researchers www.llnl.gov/str/Rsimpson.html.

Metastable alloys, www@ifw-dresdem.de.

"Nanoenergetics: An Emerging Technology Area of National Importance", by Dr. Andrzej W. Miziolek, The AMPTIAC Newsletter, Spring 2002, vol. 6, No. 1; pp. 43-48 & 67.

"Synthesis and Reactivity of a Super-Reactive Metastable Intermolecular Composite Formulation f Al/$KMnO_4$", by Anand Prakash, Alon V. McCormick and Michael R. Zachariah, Adv. Mater 2005, 17, No. 7, Apr. 4.

METHOD AND APPARATUS FOR A PROJECTILE INCORPORATING A METASTABLE INTERSTITIAL COMPOSITE MATERIAL

RELATED APPLICATIONS

The present application is a Divisional Application of U.S. patent application Ser. No. 11/145,352 filed on Jun. 3, 2005.

BACKGROUND OF THE INVENTION

Projectiles for use in applications ranging from small arms to large artillery have been designed so as to maximize the projectile's stopping-power, penetration, and/or explosive capability. Projectiles are commonly fashioned to be able to kill or disable a target within a relatively short period after impact. Further, projectiles are sometimes designed with penetration in mind so as to be capable of going through an object in order to strike something on the other side of the object. Additionally, some projectiles may incorporate explosives that detonate on impact or as some other desired time so as to damage or completely disable a target.

Projectiles may be designed in a number of ways. For instance, some conventional bullets have been designed so that the bullet will mushroom to transfer more energy into the target by presenting a surface of substantial area perpendicular to the course of travel of the bullet. Additionally or alternatively, conventional bullets have been designed so that the bullet will fragment. Doing so will lessen the total energy of the bullet during the fragmentation process and then distribute energy amongst many smaller fragments that have proportionately less inertia and move in various directions away from the original bullet course.

Larger artillery projectiles have been designed so as to incorporate an explosive charge that detonates in the vicinity of, or upon impact with, the target to provide enhanced initial shock upon explosion and, in some cases, multiple penetrations of the target by free release or directed fragmentation of the projectile's casing. Projectiles configured with a main explosive charge composed of TNT, Comp-B, Octol, C-4, Tetryl, or other material known in the art are generally designed so as to employ a fusing mechanism that includes a secondary charge of explosive, commonly of RDX, PSTN, TNT, black powder, or other energetic material known in the art that is detonated by a primer upon impact of the projectile with the target, or by a mechanical time delay, a pyrotechnic delay, or a proximity sensing fuse or other system known in the art when the projectile is in the vicinity of a target.

Other designs of projectiles are in existence. For example, one design employs a projectile with one or more rods. The projectile is designed so as to penetrate the target and then begin fragmenting to allow the rods to continue along the delivery path to further penetrate and disrupt the target.

Although various designs of projectiles exist, prior projectiles have not been capable of producing a self-propagating, high temperature reaction to render terminal effects or thermal impact to a target.

SUMMARY

Various features and advantages of the invention will be set forth in part in the following description, or may be obvious from the description, or may be learned from practice of the invention.

The present invention provides for an improved projectile that may incorporate a nanophase elemental material into a metastable interstitial composite (MIC) material. The nanophase material may be cold pressed into a desired shape of a projectile, or the material may be encased in a plurality of jackets for inclusion in a fragmentation sleeve or casing of the projectile. The materials become active during a self initiated explosion and/or impact of the target so as to stress the material and disperse it, creating a rapid thermal oxidation effect that results in a self-propagating, high temperature reaction.

In accordance with one exemplary embodiment, a projectile for creating a thermal event is provided that includes an elemental material that has a purity of at least 90%. The elemental material is at least one of aluminum, iron, magnesium, molybdenum, titanium, tantalum, lanthanum, uranium, or zirconium. The elemental material is configured to oxidize to result in a thermal event. A coating material is also present and is capable of preventing oxidation of the elemental material.

An exemplary embodiment exists in which an oxidizing agent is present and is capable of reacting with the elemental material so as to cause oxidation of the elemental material to result in a thermal event.

The projectile may be configured in accordance with another exemplary embodiment in which the coating material surrounds the elemental material so that at least some of the elemental material is separated from others of the elemental material.

Another exemplary embodiment exists in which the coating material may be made of one or more materials such as Teflon®, nylon, PVC vinyl, steric acid, carbonyl acid, and other materials known in the art. Further, the oxidizing agent may be made of one or more materials such as bismuth oxides, tungsten oxides, molybdenum oxides, titanium oxides, iron oxides, magnesium oxides, including silicon, boron, and other materials known in the art.

A further exemplary embodiment exists in a projectile as previously discussed in which a full metal jacket surrounds the elemental material and coating material. Additionally or alternatively, a ballast material (such as tungsten) that is substantially reactively inert with the elemental material and coating material may be included to provide weight to the projectile and improvement of the projectile's ballistic properties.

Another exemplary embodiment resides in a projectile as previously discussed in which the elemental material and coating material are formed into a plurality of fragments. In certain exemplary embodiments, the plurality of fragments include a jacket that encases the elemental material and coating material. Further, the plurality of fragments may be designed and fabricated to form a sleeve or casing for the projectile, or the fragments may be contained in the projectile sleeve or casing.

Also provided for in accordance with one exemplary embodiment is a projectile as previously discussed in which the elemental material and coating material are encased in a metal jacket to form a plurality of fragments and are arranged next to one another to form a plurality of fitting lines. Additionally, the immediately mentioned exemplary embodiment may further include an energetic component configured to release energy so as to break apart the fragments along the fitting lines. Also, a stress cushion layer located between the energetic component and the fragments may be provided so as to control separation and directional pattern flight of the fragments.

The present invention also provides for an exemplary embodiment that further includes an explosive charge. The explosive charge is configured for creating an explosion sufficient to cause the elemental material to oxidize, whether with air, the oxidizing agent if present, or a combination of the two.

The present invention also provides for an exemplary embodiment of a projectile for creating a thermal event that includes an elemental material capable of oxidizing to result in a rapid thermal event. A coating material may be included and may be capable of preventing oxidation of the elemental material. The elemental material has a purity of at least 75%.

In another exemplary embodiment, the projectile as immediately discussed may include an oxidizing agent mixed with the elemental material and the coating material and is isolated from the elemental material by the coating material. The oxidizing agent is capable of reacting with the elemental material so as to result in oxidation of the elemental material to cause a rapid thermal event. An explosive charge is provided and is configured for creating an explosion sufficient to induce the aforementioned oxidation of the elemental material and the oxidizing agent. Additionally, a detonator is operatively connected with the explosive charge for ignition thereof.

The present invention also provides for an exemplary embodiment as immediately discussed in which the detonator is time delayed for igniting the explosive charge at a predetermined time, distance, or rotation of travel of the projectile.

The present invention also provides for a method for causing a thermal event. The method includes the steps of firing a projectile with an elemental material capable of oxidizing, an oxidizing agent capable of reacting with the elemental material, and a coating material capable of preventing reaction between the elemental material and the oxidizing agent during the mixing and swaging stages of projectile fabrication. The method also includes the step of breaking the projectile so that the elemental material and the oxidizing agent react with one another when stressed and blended in an open air or free space environment. The reaction between the elemental material and the oxidizing agent is a self-propagating high temperature synthesis reaction and thermal event that involves oxidation of the elemental material.

Additionally, the breaking step in accordance with one exemplary embodiment may include fragmentation of the projectile into a plurality of fragments that subsequently strike, impact, and/or enter a target and target volume so as to induce the self-propagating high temperature synthesis reaction and thermal event between the elemental material and the oxidizing agent.

The present invention also provides for a projectile for creating a thermal event that has an elemental material with a purity of at least 75% that is capable of oxidizing so as to result in a rapid thermal event.

Also provided is a projectile as previously discussed in which a coating material is present and is capable of preventing oxidation of the elemental material. Alternatively, an oxidizing agent may be present and may be capable of reacting with the elemental material in order to cause oxidation of the elemental material to result in a thermal event.

A further exemplary embodiment exists in which the elemental material as previously discussed is non-passivated.

These and other features, aspects, and advantages of the present invention will become better understood with reference to the following description and appended claims. The accompanying drawings, which are incorporated in and constitute part of the specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
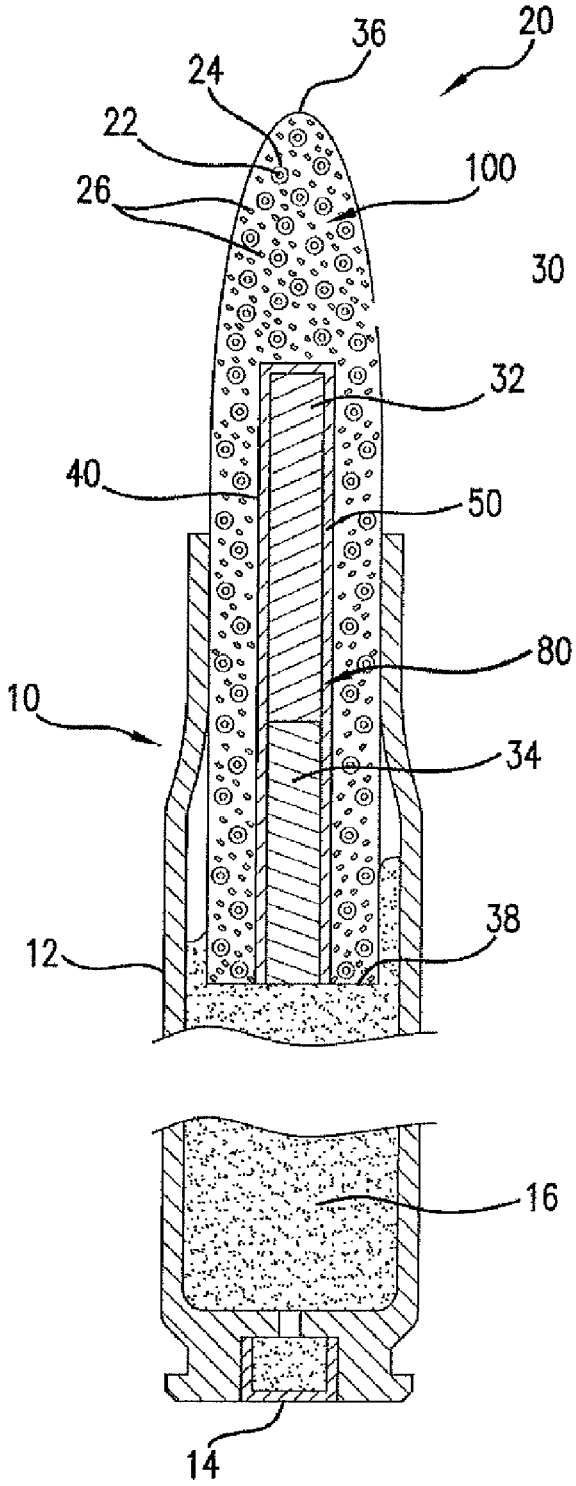
FIG. 1 is a cross-sectional view of a cartridge that includes a projectile in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield a still third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to about 7 also includes a limit of up to about 5, up to about 3, and up to about 4.5.

The present invention provides for a projectile 20 capable of producing a self-propagating, high temperature reaction. The projectile may be used, for example, to mark a target with a heat signature, destroy a target, or impede the target's performance. The projectile 20 generally includes an elemental material 22 and a coating material 24 configured to form a metastable interstitial composite (MIC) material 100. A detonation associated with the projectile 20 and/or impact of the projectile 20 with the target will remove the coating material 24 from the elemental material 22 to initiate a self-propagating, high temperature reaction and thermal event. Oxidation of the elemental material 22 may be aided by the atmosphere in addition to an oxidizing agent 26 in accordance with certain exemplary embodiments.

Figure 2:
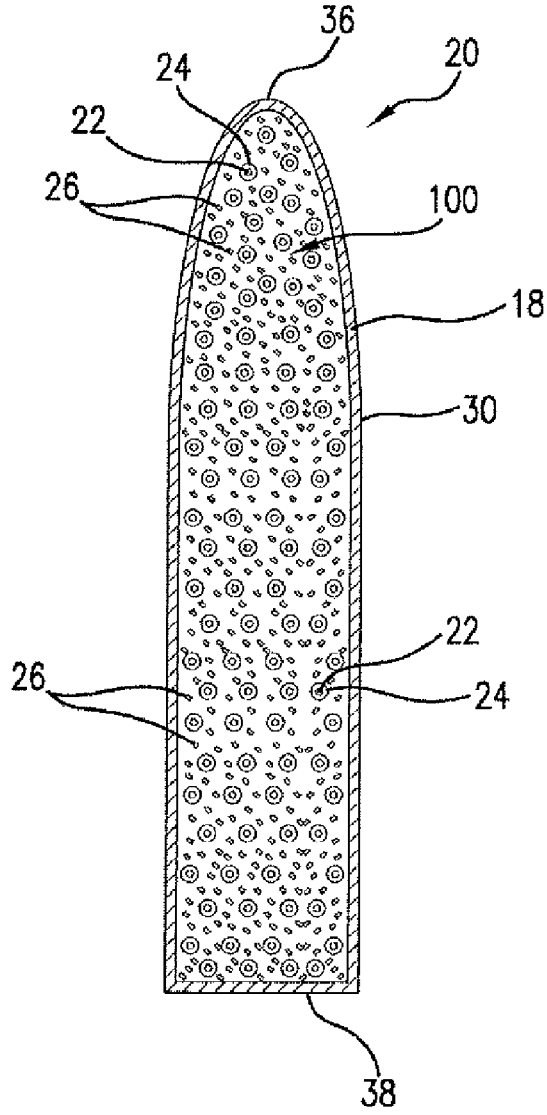
FIG. 2 is a cross-sectional view of an exemplary embodiment of a projectile encased in a full metal jacket.

FIG. 1 illustrates an unjacketed center-fired cartridge 10 containing a projectile 20 in accordance with one exemplary embodiment. The cartridge 10 includes a casing 12, primer 14, propellant 16, and the projectile 20. The casing 12, primer 14, and propellant 16 are typical components common to center-fired cartridges known in the art. The projectile 20 may have a specific gravity comparable to lead to make the projectile 20 compatible with available propellants and sighting systems. The projectile 20 is sufficiently hard to withstand firing transients caused by the propellant 16. The projectile 20 may be fully-jacketed, as shown in FIG. 2, and may also be configured in a rim-fired cartridge (not shown) that would be substantially identical to the center-fired cartridge 10 shown, except for the absence of the primer 14, in accordance with other exemplary embodiments.

In operation a user chambers the cartridge 10 that includes the projectile 20 in a weapon suited for the caliber of the cartridge 10. A firing pin in the weapon strikes the primer 14 to ignite the propellant 16 in the casing 12 and propel the projectile 20 from the casing 12 out of the weapon and toward the intended target.

The projectile 20 shown in FIG. 1 includes a self-destruct mechanism 80 that may include an explosive charge 32 and a detonator 34 to provide self-destruct capability. The explosive charge 32 and the detonator 34 may be located in a longitudinal bore 40 that is defined in the projectile 20. The projectile 20 is formed into a ballistic shape 30 that includes a front end 36 and a distal end 38. The projectile 20 is formed of a MIC material 100 that includes the elemental material 22, coating material 24, and oxidizing agent 26.

The elemental material 22 may be non-passivated (non-oxidized) or semi-passivated (partially oxidized) and may be relatively pure materials that can oxidize readily in air. The elemental material 22 may be made of small micron, sub-micron, and/or nano-phase powders of aluminum, iron, magnesium, molybdenum, lanthanum, tantalum, titanium, zirconium, and/or other materials that rapidly oxidize and are commonly known to one having ordinary skill in the art. The elemental material 22 can be safely handled in an inert gas or oil bath environment before coating and incorporation into the projectile 20.

The elemental material 22 may be a material that is configured so that at least 95% of the elemental material 22 is capable of oxidizing within 10 seconds upon contact with air and/or an oxidizing agent 26. Further, the elemental material 22 may be configured as immediately discussed in which the elemental material oxidizes within 5 seconds, 3 seconds, 2 seconds, 1 second, ½ a second, and/or ¼ of a second in accordance with other exemplary embodiments. Further, the elemental material 22 may be configured so that at feast 90%, at least 98%, and/or at least 99% of the elemental material 22 oxidizes within the previously mentioned time periods in accordance with further exemplary embodiments.

The coating material 24 coats the elemental material 22 and prevents the elemental material 22 from prematurely oxidizing. In accordance with certain exemplary embodiments, the coating material 24 may include Teflon®, a Teflon® derivative, nylon, PVC vinyl, steric acid, carbonyl acid, and/or other materials that coat or protect and are commonly known to one having ordinary skill in the art. The coating material 24 may also serve as a binding agent during pressing so as to help bind the ingredients into the desired shape. The coating material 24 allows for the elemental material 22 to be safely handled in air. Although described as coating the elemental material 22, the coating material 24 may also coat the oxidizing agent 26, if present, in accordance with various exemplary embodiments.

The coating material 24 may coat an individual or a plurality of particles of the elemental material 22. Alternatively, the coating material 24 may be a container, such as a canister or metal jacket, which holds the elemental material 22 therein so as to prevent premature oxidization. As such, the coating material 24 is an element that prevents oxidization of the elemental material 22 until a desired time.

The oxidizing agent 26 may be made of bismuth oxides, tungsten oxides, molybdenum oxides, titanium oxides, iron oxides, magnesium oxides, including silicon, boron, and/or other oxides or oxidizing compounds or materials known to one having ordinary skill in the art.

The elemental material 22, coating material 24, and oxidizing agent 26, if present, may be blended in a variety of proportions depending upon the degree of reactivity that is desired. After blending, the components may be pressed into a core slug of specific weight, length, diameter, and/or dimensions for the caliber of projectile 20 or projectile 20 fragment size and design that is desired. For instance, the components may be cold pressed, swaged, heat treated or sintered, or the components may be placed into a loose compactive powder fill in accordance with various exemplary embodiments. A variety of forming dies may be employed to cold press the aforementioned materials into a variety of projectile shapes, slugs, pellets, balls, projectile cores, fragments, aerodynamically shaped fragments, tubular walls, bomb-like fragments, cylinders, and other objects that may act as liners, segmented fragment walls in ordnance casings, ordnance casing liners, or ordnance/munition case walls. The MIC material 100 may be incorporated into fragments that can make up or surround a warhead section. The MIC material 100 may be incorporated into smaller ordnance items or into tubular walls, casings, and liners of larger ordnance items. As such, the MIC material 100 may be formed into any conceivable shape and employed in a variety of designs as is commonly known to one having ordinary skill in the art.

Incorporation of the MIC material 100 into projectiles, projectile components, and specifically designed fragments, liners, ordnance casings, and the like utilize the high velocity release of these items and their impact with targets to cause the MIC material 100 to fracture into its original powdered state prior to blending. Friction from the impact will remove the coating material 24 from the elemental material 22, permitting the elemental material 22 to rapidly oxidize. If present, the oxidizing agent 26 will mix with the elemental material 22 further oxidize the elemental material 22, producing a high temperature and pressurized event. The MIC material 100 may be configured so that the elemental material 22 is oxidized with or without the presence of the oxidizing agent 26

The elemental material 22, coating material 24, and oxidizing agent 26, if present, may be, before fabrication, a powder of small particles having a diameter on the order of 10-150 nanometers, or larger sizes ranging from 25-1000 micrometers (approximately 0.001-0.040 inches). However, particles smaller or larger than the stated diameters may be employed in accordance with various exemplary embodiments. The MIC material 100 may be a homogenous mixture of the elemental material 22, coating material 24, and oxidizing agent 26. These components may be formed into the ballistic shape 30 making up the projectile 20 by using cold (i.e., room temperature or slightly heated) pressure or swaging. This method of fabrication is known in the art and is fully described, for example, in U.S. Pat. No. 5,963,776 issued to Lowden, et al. that is incorporated herein by reference in its entirety for all purposes. Another example of a method for forming the MIC material 100 into a projectile 20 is described in U.S. Pat. No. 6,799,518 issued to Williams, the entire contents of which are incorporated by reference herein in their entirety for all purposes. The amount of pressure used in the cold swaging process may vary according to the particular target, barriers around the target, and/or the intended use of the projectile 20. For example, the fabrication pressure may be 350 MPa or greater if the projectile 20 must penetrate a hard target such as ⅜" carbon steel. Alternatively, the fabrication pressure may be 140 MPa or less if the projectile 20 is desired to break upon impact with a relatively soft target such as 1/32" sheet metal.

Although described as being intermixed in a homogeneous fashion, the components making up the MIC material 100 may be arranged differently in accordance with various exemplary embodiments. For example, the elemental material 22 may be contained in coating material 24 that is essentially in the shape of a small canister. The oxidizing agent 26 may be located outside of the canister/coating material 24 so that impact of the projectile 20 causes the canister/coating material 24 to rupture thus allowing reaction between the elemental material 22 and the oxidizing agent 26. As such, the MIC material 100 may be a homogeneous or heterogeneous mixture when configured into the projectile 20.

As stated, a variety of materials and percentage compositions exist for the elemental material 22, coating material 24, and oxidizing agent 26, if present. In accordance with one exemplary embodiment, the MIC material 100 may be made of 20% aluminum, 3% Teflon, 74% bismuth oxide, and 3% tungsten (ballast only). Alternatively, in accordance with another exemplary embodiment, the MIC material 100 may be made of 12% aluminum (80 nm), 5% Teflon, and 83% bismuth oxide. In still yet another exemplary embodiment, the MIC material 100 may be made of 33% tantalum, 3% Teflon, 60% bismuth oxide, and 4% tungsten (ballast only). The MIC material 100 could also be made of 30% tantalum, 3% teflon, 64% bismuth oxide, and 3% tungsten (ballast only). Further, the MIC material 100 could be made of 10 aluminum (80 nm), 3% teflon, 82% bismuth oxide, and 3% tungsten (ballast only). Various other exemplary embodiments exist in which 20% aluminum, 3% teflon, 72% manganese oxide, and 5% tungsten (ballast only) exist along with exemplary embodiments in which 32% tantalum, 3% teflon, 60% manganese oxide, and 5% tungsten (ballast only) are present.

Various percentage compositions of the various materials are possible for forming the MIC material 100, and it is to be understood that the aforementioned materials and percentages are only exemplary. For instance, the present invention includes MIC material 100 that is made of 10%-90% aluminum, 10%-50% tantalum, 2%-20% Teflon, 30%-95% bismuth oxide, and/or 2%-25% tungsten (ballast only).

The elemental material 22 may have a purity of at least 75%. Alternatively, the elemental material 22 may have a purity of at least 90%. Further exemplary embodiments exists in a projectile 20 with an elemental material 22 that has a purity of 96%-99%. Additionally, the elemental material 22 may be 99.9% pure in another exemplary embodiment. The elemental material 22 may be non-passivated such that 99.9% of the elemental material 22 is non-oxidized. Alternatively, the elemental material 22 may be semi-passivated such that 20%-50% of the elemental material 22 is oxidized. Alternatively, the elemental material 22 may be fully oxidized in other exemplary embodiments. Although not bound to a particular type of elemental material 22, Applicants believe that non-passivated elemental materials 22 produce the best thermal events.

FIG. 2 shows an alternative exemplary embodiment of the projectile 20 in which the MIC material 100 is encased in a full metal jacket 18. The full metal jacket 18 may be made of copper, aluminum, steel, or any other metal or composite commonly known to one having ordinary skill in the art. The use of the full metal jacket 18 allows for the projectile 20 to penetrate a target so that the full metal jacket 18 will fracture and subsequently impart forces onto the MIC material 100 to create the thermal event. The full metal jacket 18 may be constructed in any thickness or with any material so as to achieve a desired penetration of the target.

Figure 3:
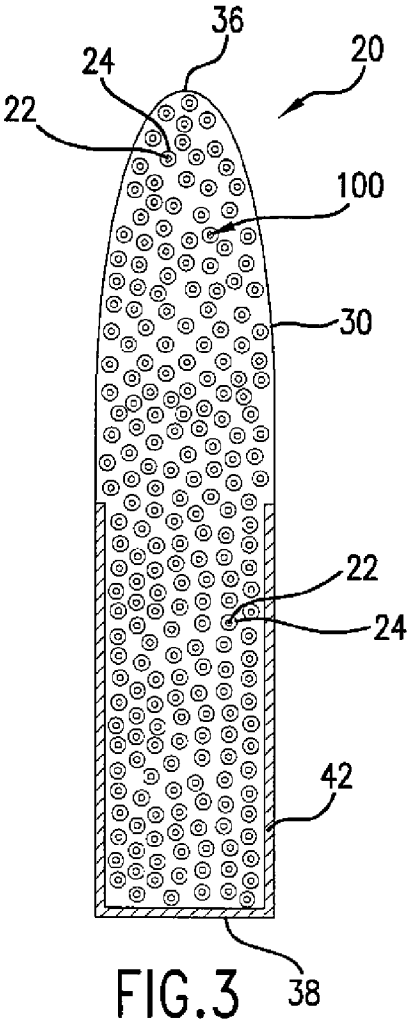
FIG. 3 is a cross-sectional view of an exemplary embodiment of a projectile encased in a half jacket.

FIG. 3 shows an alternative exemplary embodiment of the projectile 20 in which the MIC material 100 is formed into a projectile 20 that includes a partial metal jacket 42. Although previously described as including the coating material 24 and oxidizing agent 26, it is to be understood that the reactive nano-phase elemental material that may be the elemental material 22 need not include the coating material 24 and/or the oxidizing agent 26 in other exemplary embodiments. Here, the elemental material 22 will oxidize without the oxidizing agent and produce a thermal event. The coating material 24 may provide for handling and fabrication operations in an open-air environment. The oxidizing agent 26 may be added to enhance the oxidation of the elemental material 22.

Alternatively, the oxidizing agent 26 may be necessary in instances where air is not present for providing oxidation of the elemental material 22 as in the case of the vacuum of outer space, in an inert environment, underwater, or in a liquid or other material induced environment. As such, the projectile 20 may be used in or against missile bodies, warhead sections, guidance sections, in or against space satellites, other space bodies and high altitude platforms, bio-fermentors, or other chemical or biological environments. Although various exemplary embodiments herein described include the coating material 24 and the oxidizing agent 26, it is to be understood that this component is not necessary in accordance with various exemplary embodiments.

Figure 4:
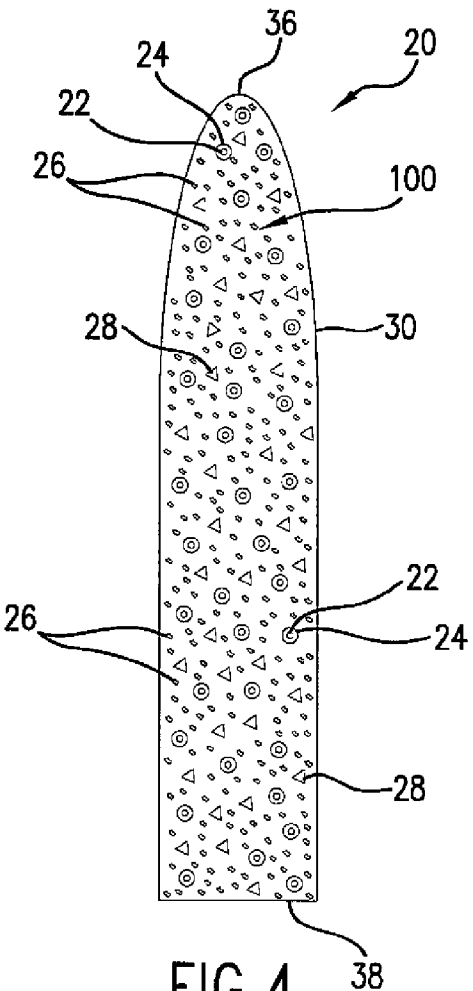
FIG. 4 is a cross-sectional view of an exemplary embodiment of a projectile that incorporates an inert material.

FIG. 4 shows an exemplary embodiment of the projectile 20 that includes ballast material 28 incorporated into the MIC material 100. The ballast material 28 provides added weight and improved ballistic properties and kinetic energy values thereof. The ballast material 28 may be inert so as to be essentially non-reactive with the elemental material 22, coating material 24, and oxidizing agent 26. The ballast material 28 helps achieve projectile and projectile fragment weights that are similar, equal to, or heavier than current projectile and fragmentation designs. The ballast material 28 may be tungsten, bismuth, lead, or other materials with density and weight properties to provide ballast, ballistic stability, higher kinetic energy values and improved penetration. The ballast material 28 may also serve as a friction inducer that assists with the fracture and dispersal of the MIC material 100 at impact and/or target penetration to aid in the effective degree of thermal reactivity. In accordance with other exemplary embodiments, only a minimum amount of or no ballast material 28 may be present to allow for lighter weight projectiles 20 and projectile fragments with higher velocities.

Figure 5:
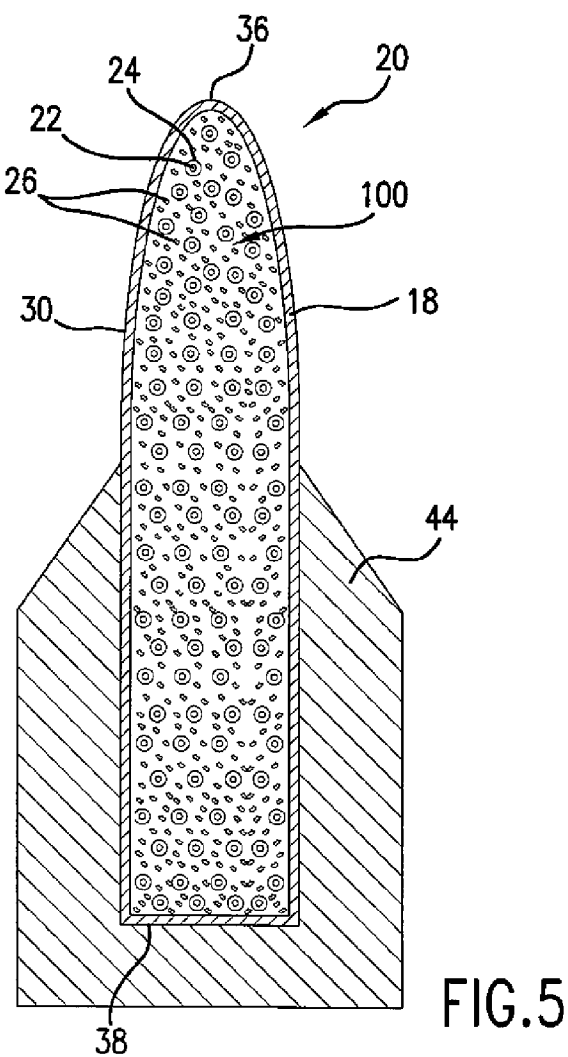
FIG. 5 is a cross-sectional view of an exemplary embodiment of a projectile incorporated into a sabot.

FIG. 5 is a cross-sectional view of an exemplary embodiment of the projectile 20 incorporated into a sabot 44. The sabot 44 may be employed in certain instances to adapt a smaller caliber projectile 20 for use in a larger caliber weapon. During operation, a portion of the sabot 44 typically remains around the casing 12 (FIG. 1) in the chamber of the weapon, while the remainder of the sabot 44 falls away from the projectile 20 shortly after exiting the weapon.

Figure 6A:
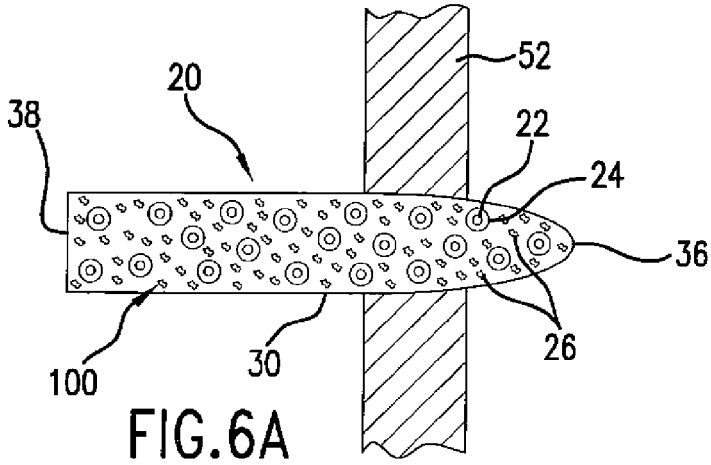
FIGS. 6A-6C are sequential views of a projectile in accordance with one exemplary embodiment penetrating a target and reacting to cause a thermal event.
Figure 6B:
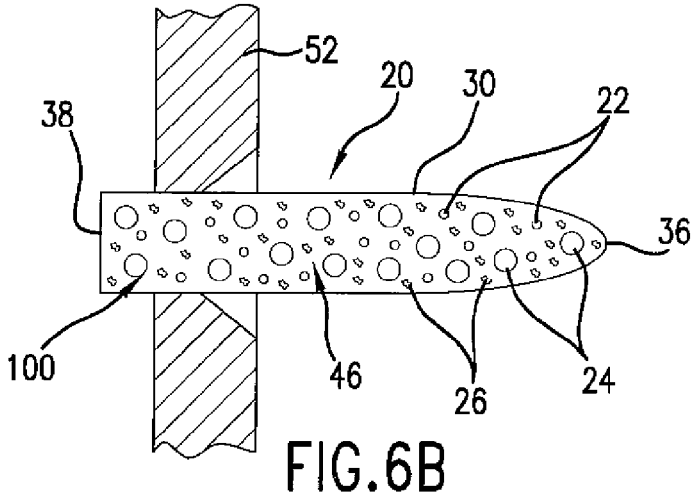
Figure 6C:
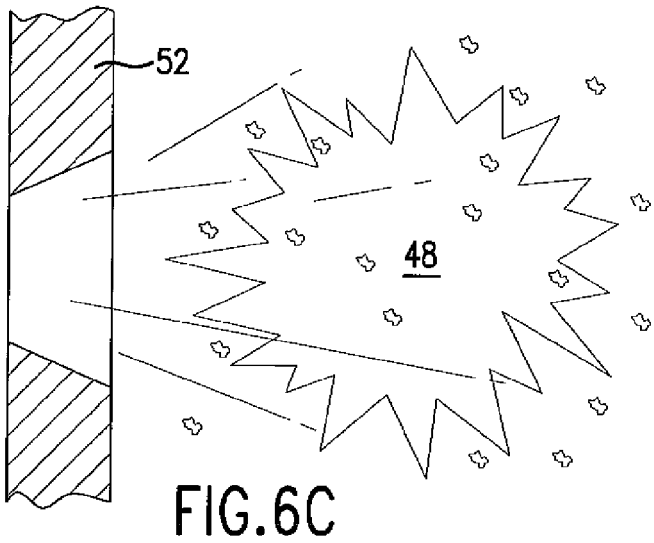

FIGS. 6A-6C illustrate impact of an embodiment of the projectile 20 with a target and the subsequent rapid oxidation of the elemental material 22. FIG. 6A shows the projectile 20 impacting a target, in this case an eighteen gauge steel panel 52. The projectile 20 is fabricated at sufficient pressure to cause the projectile 20 to penetrate the panel 52 before breaking apart to allow the MIC materials 100 blend and react. As shown in FIG. 6B, upon penetration of the steel panel 52 the elemental material 22 is stressed and exposed from the coating material 24. As the coating material 24 no longer isolates the elemental material 22, the oxidizing agent 26 reacts with the elemental material 22, thus starting oxidation of the elemental material 22. FIG. 6C shows the result of the reaction between the elemental material 22 and the oxidizing agent 26. A self-sustaining high temperature burning and pressurization event 46 may be created to destroy or damage the intended target.

Figure 7:
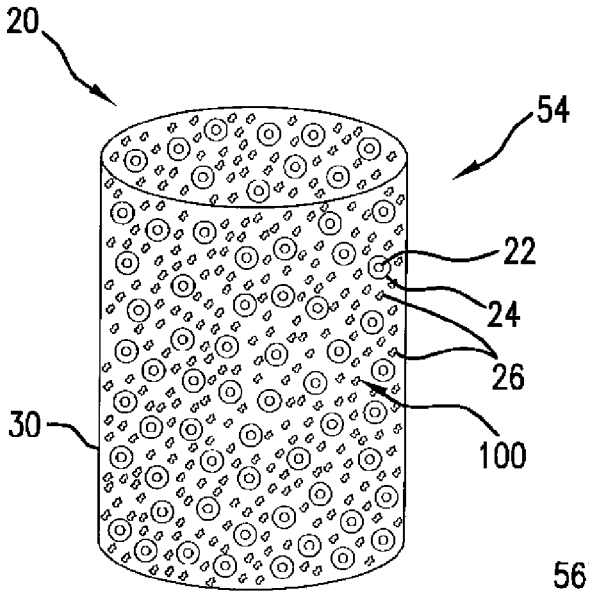
FIG. 7 is a perspective view of an exemplary embodiment of a projectile with nanophase elemental material, or nanophase elemental material that composes a metastable interstitial composite (MIC) material formed into a solid sleeve or casing.
Figure 8A:
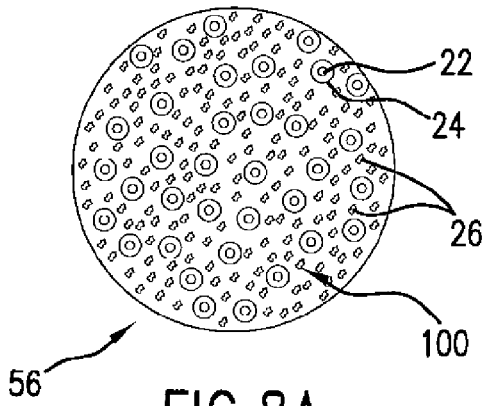
FIG. 8A is a cross-sectional view of an exemplary embodiment of a solid spherical fragment of nanophase elemental material, or a nanophase elemental material that composes a metastable interstitial composite (MIC) material.
Figure 9:
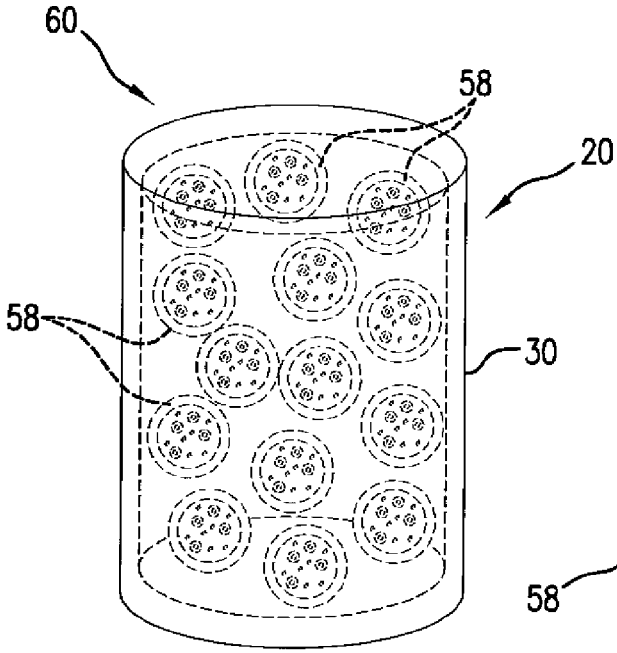
FIG. 9 is a perspective view of an exemplary embodiment of a projectile that includes the fragments of FIG. 8B housed in a sleeve or casing.
Figure 8B:
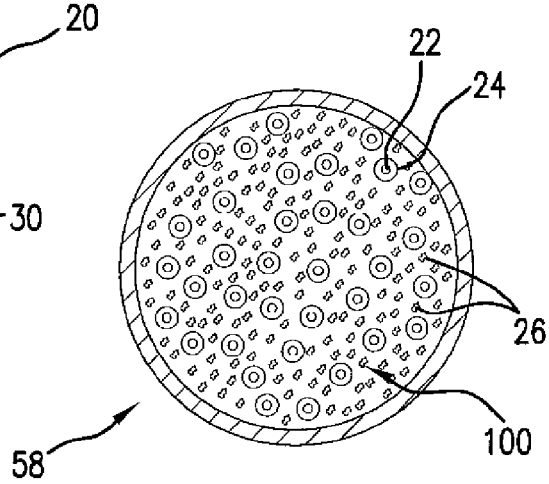
FIG. 8B is a cross-sectional view of an exemplary embodiment of a spherical fragment made of nanophase elemental material, or a nanophase elemental material that composes a metastable interstitial composite (MIC) material encased in a jacket.

The MIC material 100 may be configured in a variety of manners in accordance with various exemplary embodiments. FIG. 7 shows one exemplary embodiment in which the MIC material 100 is formed into a solid sleeve 54 for incorporation into a projectile 20 and subsequent delivery to a target. FIG. 8A shows the MIC material 100 formed into an uncoated spherical MIC fragment 56. FIG. 8B shows the MIC material 100 formed into a spherical jacket encased MIC fragment 58. The spherical jacket encased MIC fragment 58 may be designed so as to require a greater force to break apart, due to the presence of the jacket, and cause the thermal event of the KC material 100 than the uncoated spherical MIC fragment 56. The jacketed MIC fragments 58 may be more efficient for heavy panel penetrations as the jacket provides a greater degree of strength for greater penetration effects. FIG. 9 shows a sleeve 60 that holds a plurality of the spherical jacket encased MIC fragments 58. The sleeve 60 may be used to deliver the fragments 58 to an intended target. Upon impact, the MIC fragments 58 will disperse from the sleeve 60 and subsequently impact a target to result in a thermal event of the MIC material 100. Alternatively, the sleeve 60 may be broken at a point or time prior to impact with the intended target to release the fragments 58 in a scatter arrangement covering a larger area to improve the chances of subsequent target impact. Although shown as holding the spherical jacket encased MIC fragments 58, one or more of the uncoated spherical MIC fragments 56 may be contained by the sleeve 60 for delivery to a target. The sleeve 60 may be made of an epoxy, plastic, or other suitable material commonly known to one having ordinary skill in the art.

Figure 10A:
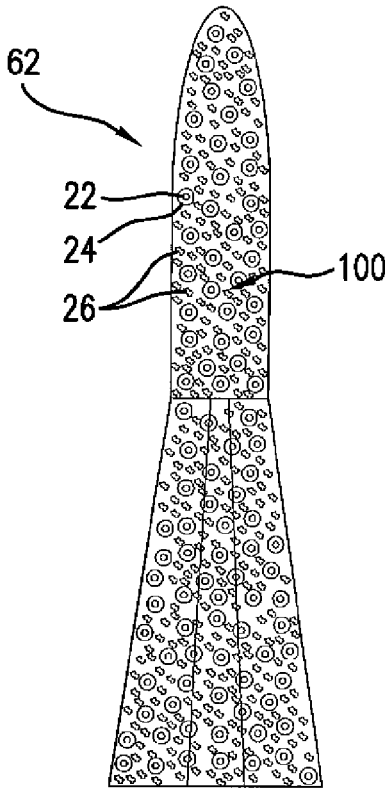
FIG. 10A is a cross-sectional view of an exemplary embodiment of a solid aerodynamically designed projectile fragment (phlichet) of nanophase elemental material, or a nanophase elemental material that composes a metastable interstitial composite (MIC) material.
Figure 10B:
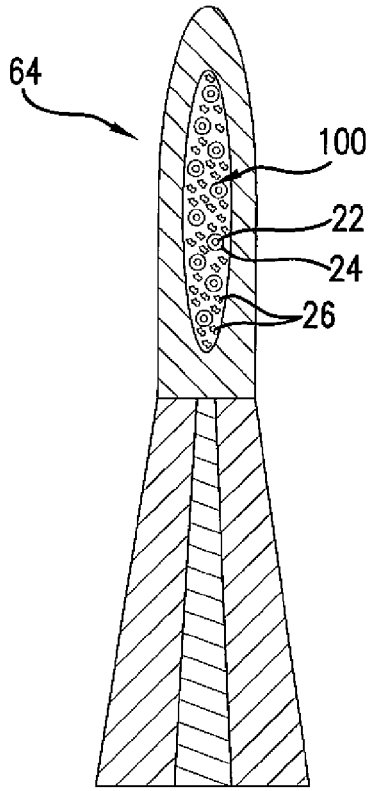
FIG. 10B is a cross-sectional view of an exemplary embodiment of nanophase elemental material, or a nanophase elemental material that composes a metastable interstitial composite (MIC) material encased in a metal jacket so as to form an aerodynamically designed projectile fragment (phlichet).
Figure 11:
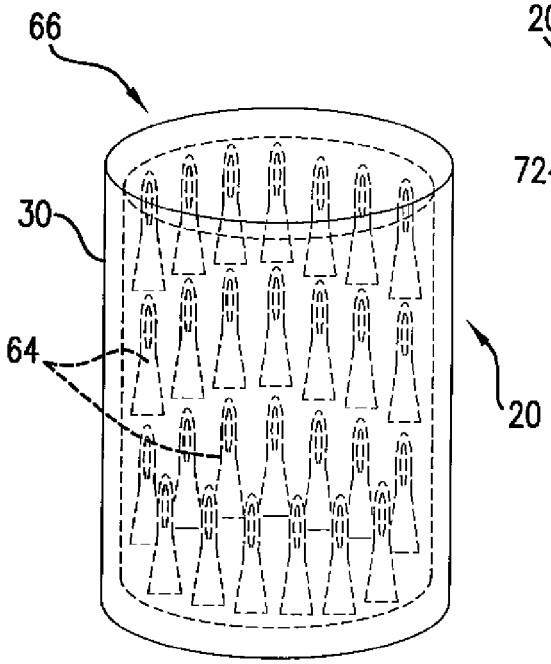
FIG. 11 is a perspective view of an exemplary embodiment of the phlichet style fragments of FIG. 10B housed in a sleeve or casing.

The MIC material 100 may be formed into fragments having a variety of styles and configurations. FIGS. 10A and 10B show the MIC material 100 formed into an uncoated bomb-like style MIC fragment 62 and incorporated into a jacket encased bomb-like style MIC fragment 64. The fragments 62 and 64 may be delivered to a target thus resulting in impact of the fragments 62 and 64 with the target and subsequent oxidation of the elemental material 22. FIG. 11 shows a plurality of the jacket encased bomb-like MIC fragments 64 housed in a sleeve 66. The sleeve 66 may be delivered to a target thus resulting in breaking of the sleeve 66, release of the jacket encased bomb-like MIC fragments 64, and subsequent impact and reaction thereof. As previously discussed with respect to the sleeve 60, sleeve 66 may be configured to detonate prior to impact with the target thus resulting in a scattering of the fragments 64 and subsequent reaction and oxidation of the elemental material 22. Again, the sleeve 66 may be configured so as to include the jacket encased bomb-like MIC fragments 64, the uncoated bomb-like MIC fragments 62, or a combination of the fragments 62 and 64.

Various exemplary embodiments are included in which the MIC material 100 may be provided in fragments that are both jacketed and unjacketed in a particular application to achieve variable effects against hard and soft targets. Additionally, various exemplary embodiments exist in which any number of variously configured fragments 56, 58, 62 and/or 64 may be included in a sleeve 66. The aforementioned configurations of the fragments of MIC material 100 are provided so as to demonstrate examples of various configurations, and it is to be understood that other configurations are possible.

Figure 12:
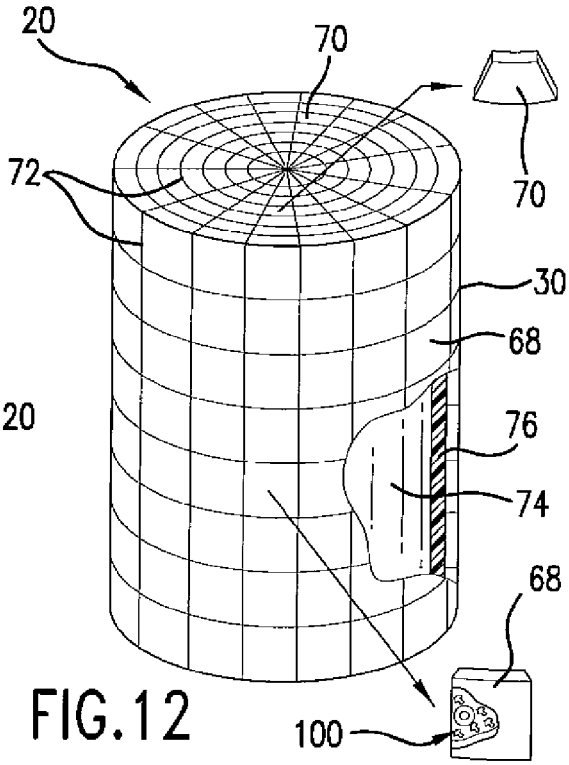
FIG. 12 is a perspective view of an exemplary embodiment of a projectile that includes a plurality of jacketed nanophase elemental material fragments, or nanophase elemental materials that compose a metastable interstitial composite (MIC) fragments arranged so as to form fitting lines so they compose the ordnance sleeve or casing.

FIG. 12 shows an exemplary embodiment of the projectile 20 that is formed into a substantially cylindrical configuration. The outer surface of the projectile 20 includes a series of jacket encased side MIC fragments 68 and a series of jacket encased top MIC fragments 70. The fragments 68 and 70 include MIC material 100 that is placed inside a jacket. The jackets may be composed of aluminum, copper, steel, or other suitable material that may be formed, pressed, sintered, or swaged around the MIC material 100. The fragments 68 and 70 are arranged to form fitting lines 72 between the various fragments 68 and 70. The projectile 20 shown in FIG. 12 may be incorporated into a warhead.

Figure 13:
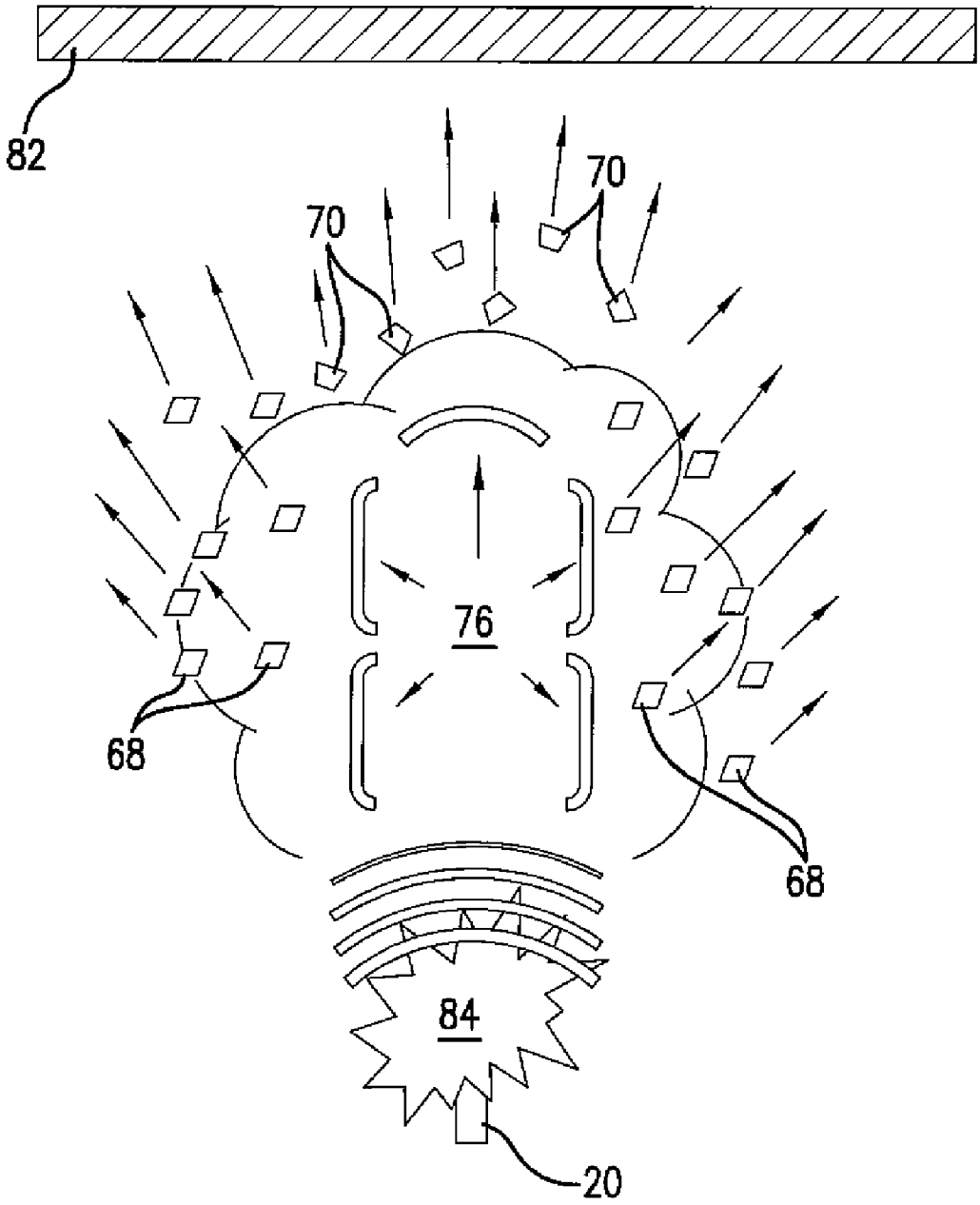
FIG. 13 is a plan view that shows explosion and fragmentation of the projectile sleeve or casing of FIG. 12 and the dispersal of the fragments.

Also provided in the projectile 20 is an energetic component 74 and a stress cushion layer 76 located intermediate the energetic component 74 and the fragments 68 and 70. FIG. 13 shows the projectile 20 of FIG. 12 after the energetic component 74 explodes to propel and break apart the fragments 68 and 70 along the fitting lines 72 into individual fragments. The energetic component may be an explosive, propellant, and/or gas pressure system or material capable of scattering the fragments 68 and 70.

The stress cushion layer 76 may be provided so as to prevent deformation and provide controlled separation of the fragments 68 and 70. The stress cushion layer 76 may also be provided to influence the directional pattern flight of the projectile fragments 68 and 70. The stress cushion layer 76 may be made of a soft metal or a hard rubber/polytype material. As shown in FIG. 13, a combination of the energetic component 74 and the stress cushion layer 76 helps to distribute the fragments 68 and 70 into a desired pattern. The projectile 20 is directed towards a target 82, and the energetic component 74 creates an explosion 84 at a point or time prior to impact with the target 82 to fragment the projectile 20.

Figure 14:
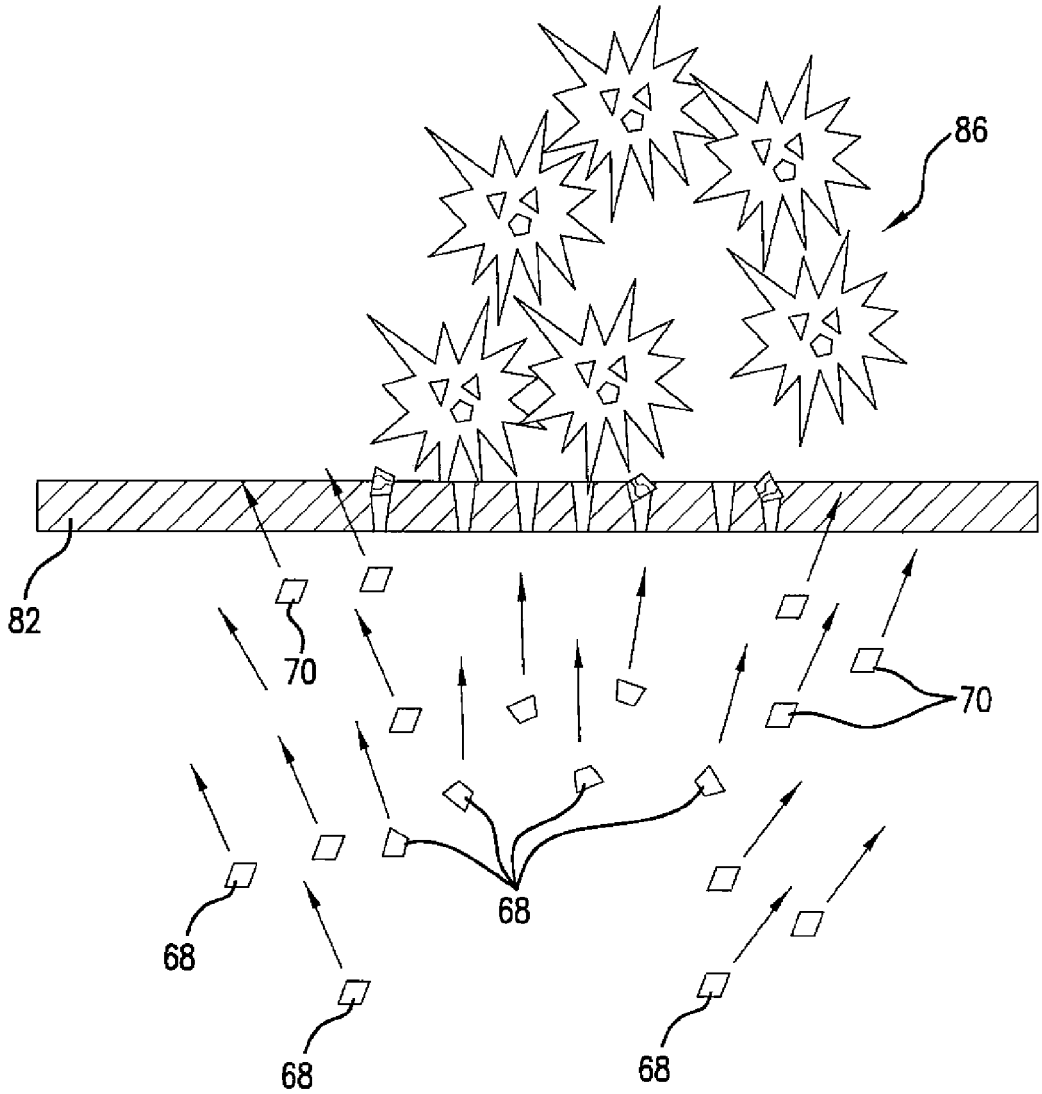
FIG. 14 is a plan view that shows the projectile fragments of FIG. 13 after striking a target and initiating a thermal event.

FIG. 14 shows the fragments 68 and 70 of FIG. 13 at a later point or time. As shown, some of the jacket encased top MIC fragments 70 have impacted the target 82. During impact with the target 82, the jacket of the MIC fragment 70 breaks and results in forces being applied to disperse the MIC material 100 to produce a thermal event. The jacket encased side MIC fragments 68 may be subsequently transferred to the target 82 and explode in a similar manner. Alternatively, the projectile 20 may be configured so that the jacket encased top MIC fragments 70 penetrate the target 82 and create an opening through which a portion of the jacket encased side MIC fragments 68 may pass to impact and cause explosions 86 at a point of deeper penetration.

The stress cushion layer 76 acts to make the explosive wave more uniformed during detonation and provide a softer separation and launch of the projectile fragments 68 and 70 at higher velocities. Higher velocities at impact may be used to provide for a higher thermal event of the MIC material 100. The MIC material 100 may be incorporated into projectiles 20 that travel at any speed.

Figure 15A:
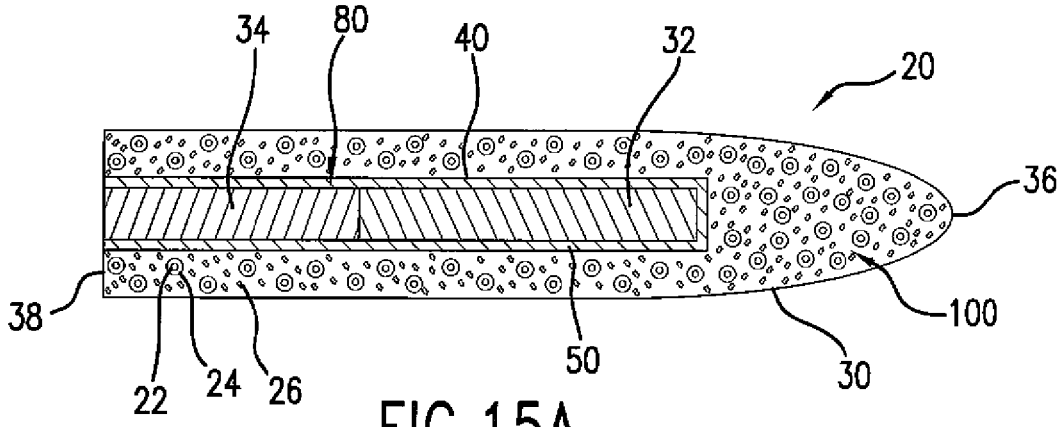
FIGS. 15A-15C are sequential views that show an exemplary embodiment of a projectile that employs an explosive charge so as to detonate and cause an enhanced energetic event from the added benefit of nanophase elemental material, or a nanophase elemental material that composes a metastable interstitial composite (MIC).

FIG. 15A shows a projectile 20 in accordance with one exemplary embodiment that includes an explosive charge 32 and a detonator 34 in a longitudinal bore 40 of the projectile 20. The longitudinal bore 40 may be drilled or machined into the distal end 38 of the projectile 20. Alternatively, the longitudinal bore 40 may be formed through sintering or cold swaging fabrication using an appropriate forming die.

The particular size, shape, and volume of the longitudinal bore 40 may be selected or made as a function of the sintering or cold swaging fabrication pressure, size of the projectile 20, volume required for the explosive charge 32 and detonator 34, and/or for the volume required for any additional material to be contained therein. For instance, a higher fabrication pressure conforming the MIC materials 100 into the ballistic shape 30 may require a corresponding larger volume for the longitudinal bore 40 to contain a sufficient explosive charge 32 to ensure breakup of the projectile 20. Conversely, a smaller volume for the longitudinal bore 40 made be suitable for softer or smaller projectiles 20 so as to hold a smaller explosive charge 32 and/or detonator 34. The size, shape and volume of the longitudinal bore 40 may be provided so as to accommodate any desired elements.

The projectile 20 may include a self-destruct mechanism 80 to ensure the MIC material 100 reacts and starts to create a thermal event even if the projectile 20 misses the intended target. Additionally or alternatively, the projectile 20 may be configured with a self-destruct mechanism 80 so that the MIC material 100 creates a thermal event before the projectile 20 strikes the target or at the same time the projectile 20 strikes the intended target.

The explosive charge 32 and the detonator 34 provide a self-destruct capability of the projectile 20 to ensure substantially complete breakup of the projectile 20 into its constituent components with or without impact of the target of the projectile 20. The explosive charge 32 may be made of any explosive powder, chemical, paste, or gas having sufficient destructive power to break apart the projectile 20 and/or cause the MIC material 100 to initiate a thermal event. The explosive charge 32 may include gunpowder, trinitrotoluene (TNT), ammonium nitrate, amatol, trinitromethylbenzene, hexanitrobenzene, and/or composite explosives such as C4 or other explosives available and known to one of ordinary skill in the art. Additionally, RDX, PETN, PBX, octol, HMX, lead styphnate, lead azide, mercury fulminate, barium nitrate, or other explosive mixtures may be used as the entire explosive charge 32 or may comprise a portion of the explosive charge 32 in other exemplary embodiments.

Figure 15B:
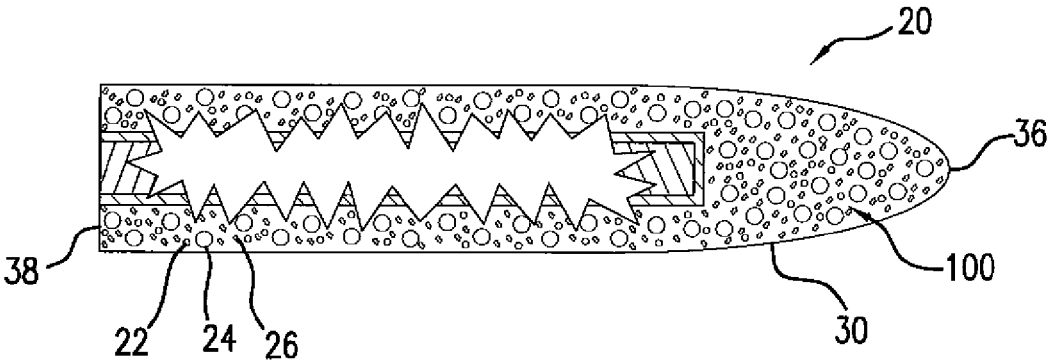
Figure 15C:
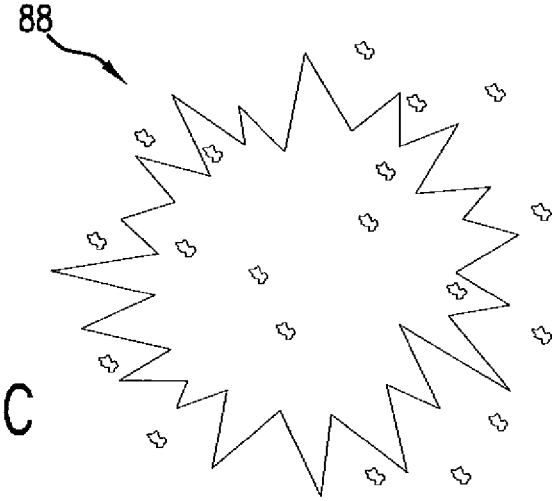

FIG. 15A shows the projectile 20 before the initiation of the self-destruct mechanism 80. In FIG. 15B, the detonator 34 has triggered the explosive charge 32 so that the MIC material 100 components are disturbed thus resulting in the elemental material 22 reacting with the oxidizing agent 26. FIG. 15C shows the thermal event between the elemental material 22 and the oxidizing agent 26.

Referring to FIG. 1, the projectile 20 may be configured so that the detonator 34 makes use of a powder train time fuse that ignites at the same time that the propellant 16 ignites in the casing 12 and launches the projectile 20 from the barrel. The powder train time fuse will burn while the projectile 20 is in flight. If the projectile 20 encounters its target, impact will cause the MIC material 100 to thermally react and therefore destroy the projectile 20. If the projectile 20 misses its target, the time fuse in the detonator 34 will continue to burn in the missed target stage of the projectile 20 and will then ignite a primary explosive compound, for example lead styphnate, lead azide, mercury fulminate, barium nitrate or other primary explosive mixture, that makes up a part of the explosive charge 32. When the primary explosive charge ignites and detonates, the heat and shock transfer produced will cause detonation of a less sensitive, more stable, and more powerful secondary explosive charge that makes up the rest of the explosive charge 32. Examples of the secondary explosive charge include RDX, PSTN, TNT, PBX, octol, HMX, tetryl, ammonium nitrate, amatol, trinitromethylbenzene, hexanitrobenzene, or a composite explosive such as C4 or other explosive material known to one having ordinary skill in the art.

The detonator 34 may include a programmable fuse, a pyrotechnic powder train fuse, a breach fuse, a mussel fuse, an infrared activated fuse, a rotational fuse and/or a radio wave receiver or transmission fuse in accordance with various exemplary embodiments. The detonator 34 may include a time fuse made of a pre-set mixture of black powder, smokeless powder, or other incendiary mixture to allow for a specific time delay burn rate. The delay burn rate may be 0.50 seconds, 0.78 seconds, 1.23 seconds, or 2.40 seconds. The time fuse may be used to ignite a primary explosive mixture for pre-ignition of the detonator 34 that is operably connected to the explosive charge 32 to ignite the explosive charge 32 to break up the projectile 20 and cause the MIC material 100 to react thus resulting in a thermal explosion. As such, the detonator 34 may provide a desired time delay between firing of the projectile 20 and ignition of the explosive charge 32. It may be desirable to include the self-destruct mechanism 80 so as to prevent the projectile 20 from hitting objects other than the intended target.

In accordance with various exemplary embodiments, the detonator 34 may include any suitable electric or programmable timed electric unit, or the detonator 34 may include any pyrotechnic time device for providing a delay between firing of the projectile 20 and ignition of the explosive charge 32. The self-destruct mechanism 80 may be configured to actuate based on parameters such as time of travel, distance of travel, or rotation of the projectile 20. Additionally or alternatively, the self-destruct mechanism 80 may be configured to actuate via a radio wave transmission.

A retainer cup 50 may be provided so as to contain the explosive charge 32 in the detonator 34. As such, the retainer cup 50 may allow for the explosive charge 32 and detonator 34 to be separately manufactured and assembled for subsequent installation into the longitudinal 40 of the projectile 20.

The projectile 20 may include other components in accordance with other exemplary embodiments of the present invention. For example, an optical marker may be included in the projectile 20 in accordance with various exemplary embodiments. Various examples of optical markers that may be included in the projectile 20 may be found in U.S. patent application Ser. No. 11/017,430 entitled "Method And Apparatus For Self-Destruct Frangible Projectiles" whose inventors are Keith Williams, Michael Maston and Scott Martin, filed on Dec. 20, 2004, the entire contents of which are incorporated by reference herein in their entirety for all purposes. Additionally, long rod penetrators and/or hard bullet tips may be incorporated into the projectile 20 for added penetration effects. These and other components that may be incorporated into the projectile 20 are described in U.S. Pat. No. 6,799,518 issued to Williams and U.S. patent application Ser. No. 11/017,430, the entire contents of which are incorporated by reference herein in their entirety for all purposes.

The projectile 20 may be configured so as to be compatible with conventional small and large caliber fire arms, as well as with larger delivery platforms such as those used in the military for projectiles, penetrators, and ordnance items that break apart such that the ordnance casing is surrounded by an explosive warhead also made of the NC material 100. Additionally or alternatively, the ordnance item may carry specifically designed fragments that may impact or penetrate a target to impose fracture of the fragments and release of the cold pressed MIC material 100 into its original powders so as to induce a thermal event.

The MIC material 100 may be incorporated into projectiles or fragments for various warhead applications. The MIC material 100 may be encased into fragments around a warhead and/or an energetic component 74 (FIG. 12) that is either explosive driven, propellant driven, volatile fuel driven or drive by a solid or pressurized gas propulsion system. The MIC material 100 may also be incorporated into projectiles 20 that act like buckshot in a shotgun shell. The MIC material 100 may be incorporated into projectiles 20 of any caliber. For instance, the projectile 20 may be sized so as to be smaller than a 0.22 caliber bullet. For instance, the projectile 20 may be made ⅓ the size of or ¼ the size of a 0.22 caliber bullet in accordance with various exemplary embodiments. Additionally, the projectile 20 may also be made so as to be sized from a 0.22 caliber bullet up to a 0.38 caliber bullet. Additionally, the projectile 20 may be sized so as to be up to and including a 0.50 caliber bullet in accordance with various exemplary embodiments. It is to be understood that various exemplary embodiments exist in which the projectile 20 may be of any caliber known to one having ordinary skill in the art.

The MIC material 100 may be incorporated into projectiles 20 that may operate in an air-free environment, such as in the vacuum of space. For example, the projectile 20 may be fired at a satellite or other object in space so as to penetrate the object thus causing the oxidizing agent 26 to react with the elemental material 22 and produce a subsequent thermal event. As such, an explosion may be realized even without the presence of air.

It should be understood that the present invention includes various modifications that can be made to the embodiments of the method and apparatus for a projectile 20 that incorporates a reactive nano-phase elemental material that may be blended with coating materials and oxidizing agents to form a metastable interstitial composite described herein as come within the scope of the appended claims and their equivalents.

What is claimed is:

1. A method of causing a thermal event, comprising:

firing a projectile having an elemental material capable of oxidizing, an oxidizing agent capable of reacting with said elemental material, and a coating material capable of preventing reaction between said elemental material and said oxidizing agent;

fragmenting said projectile into a plurality of fragments; and reacting said elemental material with said oxidizing agent so that 90% of said elemental material oxidizes within 10 seconds.

2. The method as in claim 1, further comprising striking a target with said projectile.

3. The method as in claim 1, further including striking a target with at least one of said plurality of fragments.

4. A method of manufacturing a projectile that can create a thermal event, comprising swaging an elemental material having a purity of at least 75% into a desired shape, wherein at least 90% of said elemental material oxidizes within 10 seconds of exposure to oxygen to produce said thermal event.

5. The method as in claim 4, further comprising coating said elemental material with a coating material to prevent oxidation of said elemental material.

6. The method as in claim 5 further comprising swaging an oxidizing agent with said elemental material and said coating material into said desired shape, wherein said oxidizing agent is capable of causing 90% of said elemental material to oxidize within 10 seconds to produce said thermal event.

7. The method as in claim 4 further comprising coating said elemental material with at least one of polytetrafluoroethylene, perfluoroalkoxy, fluorinated ethylene propylene, polyamide, PVC vinyl, steric acid, or carbonyl acid.

8. The method as in claim 4, further comprising surrounding said desired shape with a full metal jacket.

9. The method as in claim 4, further comprising swaging a ballast material with said elemental material into said desired shape.

10. The method as in claim 4, further comprising swaging said elemental material into a plurality of desired shapes and joining said plurality of desired shapes to form said projectile.

11. The method as in claim 10, further comprising encasing said plurality of desired shapes in a casing.

12. A method of manufacturing a projectile that can create a thermal event, comprising coating an elemental material having a purity of at least 75% with a coating material and swaging said elemental material and said coating material into a desired shape, wherein at least 90% of said elemental material oxidizes within 10 seconds of exposure to oxygen to produce said thermal event.

13. The method as in claim 12, further comprising attaching an explosive charge to said desired shape.

14. The method as in claim 13, further comprising attaching a detonator to said explosive charge.

15. The method as in claim 12, further comprising coating said elemental material with at least one of polytetrafluoroethylene, perfluoroalkoxy, fluorinated ethylene propylene, polyamide, PVC vinyl, steric acid, or carbonyl acid.

16. The method as in claim 12, further comprising swaging an oxidizing agent with said elemental material and said coating material into said desired shape, wherein said oxidizing agent is capable of causing 90% of said elemental material to oxidize within 10 seconds to produce said thermal event.

17. The method as in claim 12, further comprising surrounding said desired shape with a full metal jacket.

18. The method as in claim 12, further comprising swaging a ballast material with said elemental material and said coating material into said desired shape.

19. The method as in claim 12, further comprising swaging said elemental material and said coating material into a plurality of desired shapes and joining said plurality of desired shapes to form said projectile.

20. The method as in claim 19, further comprising encasing said plurality of desired shapes in a casing.

* * * * *